United States Patent [19]

Anger

[11] 4,240,373

[45] Dec. 23, 1980

[54] SPRAYCOATING APPARATUS WITH A HORIZONTAL RUN-IN FOR CYLINDRICAL BODIES

[75] Inventor: Rudolf Anger, Kirchheim-Teck, Fed. Rep. of Germany

[73] Assignee: Sprimag Spritzmaschinenbau GmbH, Fed. Rep. of Germany

[21] Appl. No.: 965,752

[22] Filed: Dec. 4, 1978

[30] Foreign Application Priority Data

Dec. 5, 1977 [DE] Fed. Rep. of Germany ..... 2754136

[51] Int. Cl.[3] ..... B05C 5/00; B05C 13/02

[52] U.S. Cl. ..... 118/301; 118/70; 118/315; 118/318; 118/319; 118/321; 134/134

[58] Field of Search ..... 118/319, 70, 318, 315, 118/320, 323, 321, 301; 134/134, 66, 78, 79, 133, 152, 170, 112; 15/60, 63

[56] References Cited

U.S. PATENT DOCUMENTS

| | | | |
|---|---|---|---|
| 932,609 | 8/1909 | Hodgson | 118/318 X |
| 1,104,503 | 7/1914 | Hodgson | 118/318 X |
| 1,700,697 | 1/1929 | Draper | 118/320 X |
| 2,324,890 | 7/1943 | Temple | 118/319 X |
| 4,077,356 | 3/1978 | Andrews | 118/320 X |

*Primary Examiner*—John P. McIntosh

*Attorney, Agent, or Firm*—Schwartz, Jeffery, Schwaab, Mack, Blumenthal & Koch

[57] ABSTRACT

In a spraycoating apparatus for round workpieces such as drums, the drums are supported on turning cones while being sprayed. The turning cones are supported on pins moved round in part of a circle from an inlet to an outlet about a horizontal axis. Spray units for putting on the spraycoating material are able to be changed in angle and to undergo adjustment.

17 Claims, 3 Drawing Figures

SPRAYCOATING APPARATUS WITH A HORIZONTAL RUN-IN FOR CYLINDRICAL BODIES

BACKGROUND OF THE INVENTION

1. Field of invention

The invention relates to a spraycoating apparatus with a horizontal run-in system for cylindrical bodies to be spraycoated, such as barrels, bins, drums, buckets and the like with an inlet structure with a timing lever, with spraycoating units, placed in a housing, for air or airless spraycoating or compound air and airless spraycoating of the walls and floors of the bodies, with liquid run-off walls, with draw off, washing-out and cleaning units, with a system with rolling cones for turning the cylindrical bodies about their axes at the time of spraycoating and with a structure having an outlet opening.

2. Earlier systems

In one earlier spraycoating apparatus of this sort for barrels or drums use was made of a sloping inlet runway, on which the barrels were able to roll under the effect of their weight, and, using a lever, the barrels were run one after the other onto a horizontally placed spraycoating support. On the spraycoating support the barrel was so acted upon by rolling bodies that it was turned about its axis. Placed round the spraycoating support coating units were placed, which on turning of the barrel about its axis made certain of complete coating of the barrel on the outer face of the wall and on the floor of the barrel. Using a transport system the barrel was lifted from the spraycoating support and moved into an outlet structure. After a spraycoated barrel had gone out of the apparatus by way of the outlet, the lever at the inlet structure was worked for letting a new barrel be run onto the spraycoating support. The spraycoating support, in the form of a lifting structure, and the spraycoating unit were joined by a housing with a draw-off system and with washing and separating plant for the mist of the spraycoating material.

However such an apparatus is not generally in line with present-day needs with respect (a) to the spraycoating output per hour because, in fact, such an apparatus was limited, dependent on the spraycoating process used, and on the spraycoating material, to 400 barrels each hour in the case of three color coatings and (b) to the time needed for making changes for other sizes of workpieces to be spraycoated, because such changes had to be made by hand by undoing, changing in position, adjustment and fixing of the powered rolling bodies and making use of a complete different lifting support.

SHORT OUTLINE OF THE INVENTION

One purpose of the invention is that of making such a better design of the spraycoating apparatus of the sort noted that the spraycoating output is greatly increased, that simple changeover to be in line with other sizes of the workpieces to be spraycoated is possible and, nevertheless, the amount of spraycoating material used for each workpiece or barrel is kept low while, on the other hand, spraycoating work of high quality is made certain of.

For effecting these and other purposes the apparatus of the invention has a turning upright transport structure made up of an upright transport wheel with horizontal support pins with the rolling cones, the transport structure having a driving unit for unbroken transport of the barrels from the inlet structure to the outlet structure and the spraycoating units are able to be changed in angle and to undergo adjustment.

Further developments of the invention of good effect are made clear in the dependent claims.

LIST OF THE FIGURES

An account will now be given of one form of the invention, that is to say of a spraycoating apparatus for barrels, use being made of the diagrammatic figures of the drawing.

DETAILED ACCOUNT OF ONE FORM OF THE INVENTION

Figure 1:
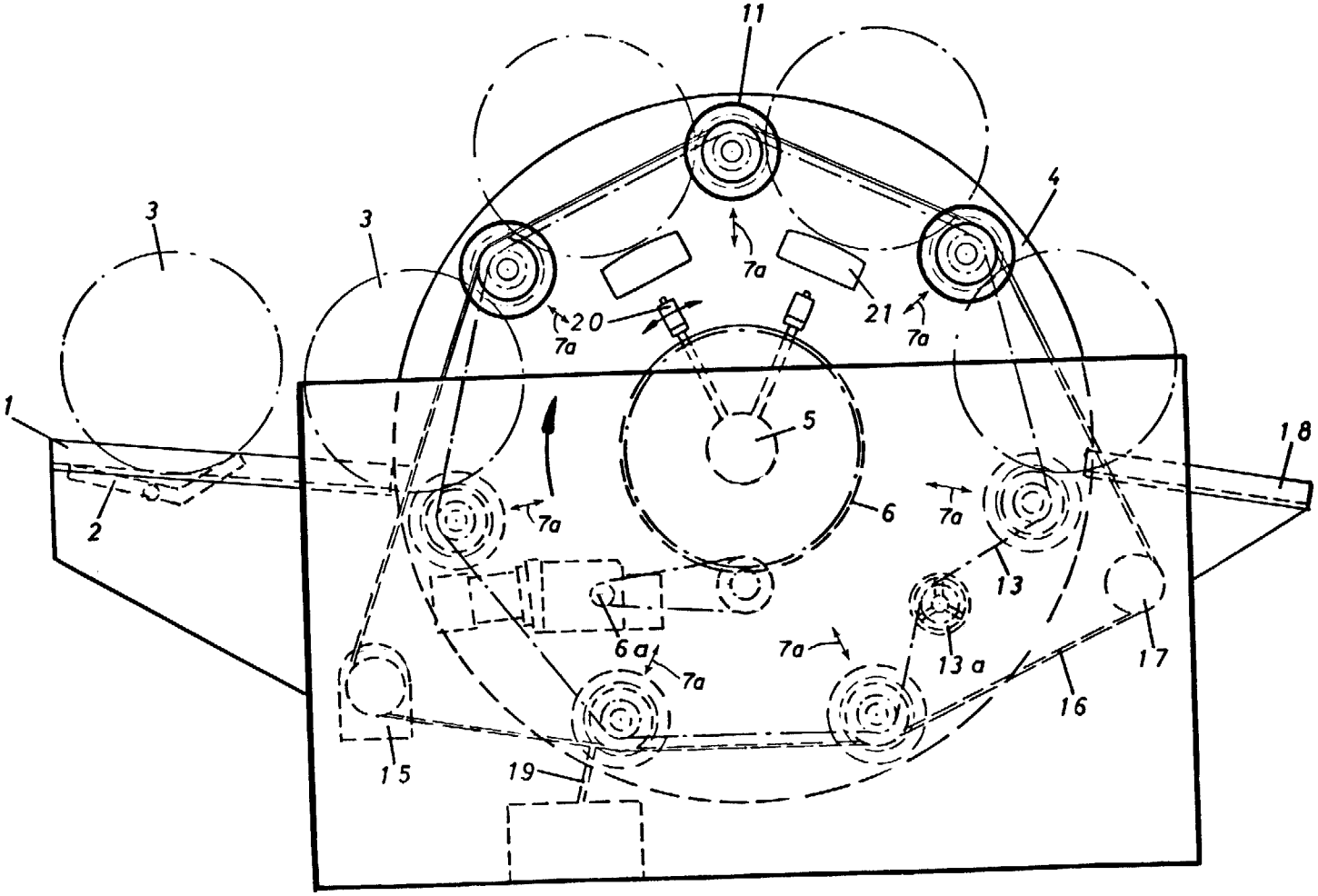
FIG. 1 is a view from the side of a spraycoating apparatus, in which the motion of the barrels from the inlet structure to the outlet structure is to be seen.
Figure 2:
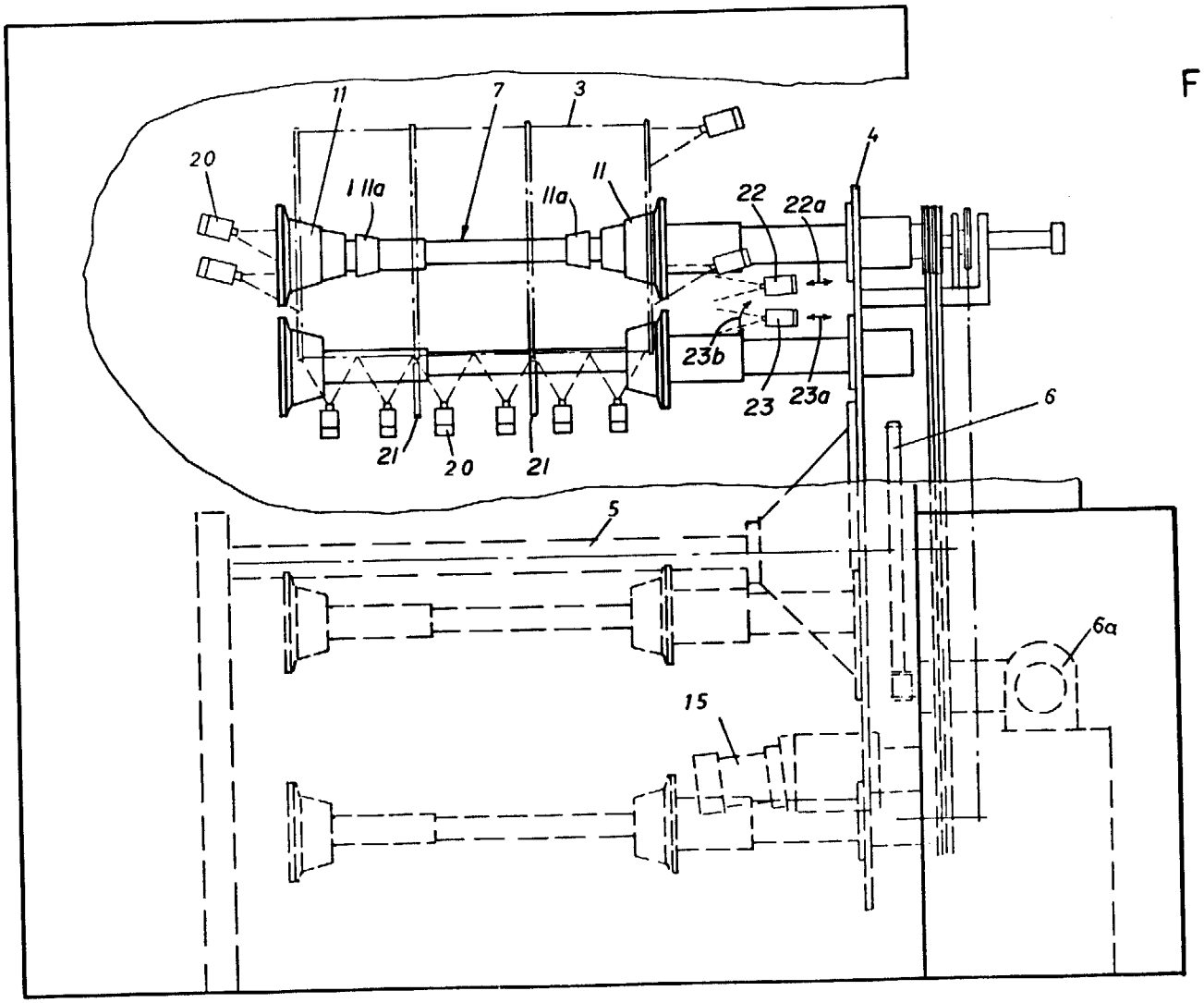
FIG. 2 is a view of the apparatus from the outlet end or side.
Figure 3:
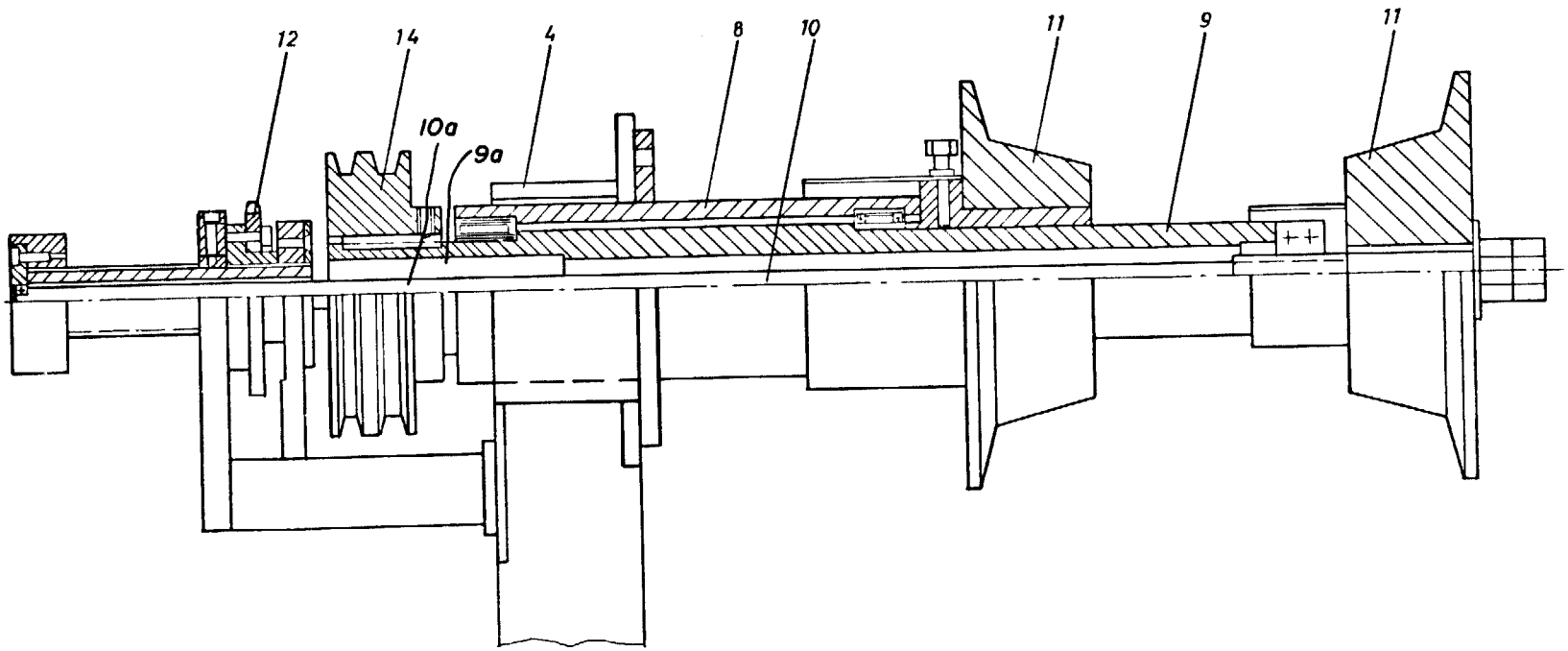
FIG. 3 is a view of a support pin.

The spraycoating apparatus to be seen in the figures has liquid run-off walls, drawing off, clearing and separating units of normal design, which are not given an account here. Furthermore the spraying apparatus has a sloping inlet structure 1, under which a lever 2 is placed for controlling or timing the run-in of barrels 3 into the spraying apparatus.

In the middle space or chamber of the spraycoating apparatus there is to the side an upright transport wheel 4 supported by a shaft 5 able to be turned in a number of bearings. At one side the transport wheel 4 has a spur gearwheel 6, which is joined by way of a driving system with a turning driving unit **6*a* for turning the wheel 4 without stopping, that is to say unbrokenly or continuously. At the outer edge of the transport wheel 4 there are, with the same distribution angle between them, seven support pins 7, able to undergo adjustment in the long-direction. These support pins 7 are themselves supported in a guide tube 8 fixedly joined to the transport wheel 4, so that the pins 7 are horizontal and may be turned. Dependent on the conditions and on the sizes of the workpieces or bodies to be spraycoated more or less support pins may be present. The support pins 7 are made up of a bush 9 and a shaft 10, and the shaft 10 is placed inside the bush 9. In the shaft 10 there is a guideway 10*a* and in the bush there is a guideway-key 9*a*, and for this reason it is only possible for the bush 9 and the shaft 10 to be turned together. On the bush 9 and on the shaft 10 there is one rolling cone 11 in each case, the cone faces being sloping towards each other. Each bush and shaft may furthermore have two or more rolling cones with different sizes 11, 11*a* or, as a further possible design, stepped cones such as 11** for making possible use with workpieces for spraycoating which are very much different to each other in diameter.

A further possible design, not to be seen in the figure, is one in which, for this purpose, all support pins 7 are placed in the transport wheel in guides so as to be able to be moved radially as shown by arrows **7*a* and, in this case, guide rollers, able to be changed in slope, are then needed for the chain 13 and V-belt 16** for adjustment in this respect to be in line with the necessary length in each different case.

A nut is fixed inside the shaft 10 and is threaded on a screw rod which is fixed to the bush 9, but is able to be turned. The threaded rod is joined with a chain wheel 12. A chain 13 is placed running over all chain wheels 12 and furthermore over the driving wheel of a driving unit 13*a* placed on the transport wheel 4 and able to be changed over in its direction of running. On turning on the driving unit 13 by way of the chain 13 and the chain wheels 12 or sprocket wheels the screwed rods are turned and for this reason, because they are in connection with the nuts, all shafts 10 are moved inwards or outwards at the same time dependent on the direction of turning and, for this reason, the distance between the rolling cones 11 is changed.

On the bush 9 there is a V-belt wheel 14 or pulley. The apparatus has a further driving unit 15 driving V-belts 15 which by way of the V-belt wheel 14 of the support pins 7 and a guide roller are so guided that in each case only five support pins 7 are powered, that is to say turned (see FIG. 1). Two support pins 7 are not powered in each position of the transport wheel, that is to say under the inlet structure 1 and under outlet structure 18. This makes certain that when barrel 3 is taken up in and taken from the apparatus, it is not acted upon by any overly great turning forces, this making possible smooth transport of barrels 3. The three support pins 7 in the top part of the apparatus are turned for turning the barrels 3 on their axes. The two lower support pins 7 are on the one hand turned to make a further guide roller unnecessary and on the other because in the lower part of the apparatus there is a cleaning unit 19 for automatic cleaning of the support pins 7, more specially their rolling cones 11, this needing turning of the support pins 7 in this part of the apparatus.

At the end opposite to the driving ends, support pins 7 are supported. There is however a further possible form of design in which they are kept in position by a joining frame or a second support wheel, which in this case would be changed in position on shaft 5 by way of a pushing cylinder. If a second transport wheel is used, shafts 10 may be joined to it and, for this reason, be changed in position as well, so that there is no need for separate systems for adjustment in the long-direction of the support pins by screwed rods, nuts, chain wheels 12, a chain 13 and a driving unit 13*a*.

The spraycoating units in the form of spray guns 20, able to undergo adjustment, for airless or air spraycoating, are placed around the shaft 5 so as to be turned or changed in slope. The spray guns 20 are fixed at the best spraying distance. The turning or sloping motion of the spray gun is kept in step with the turning motion of the transport wheel 4 and the turning motion about their axes of the vessels or barrels 3 in such a way that the spraying material coming from the guns 20 for the walls is in each case at a right angle to the tangent to the wall of the barrel as the last-named 3 is turned about its axis. Because of this the amount of spraycoating material used is kept low, because there is no loss of spraycoating material. This is because the lines of spraycoating material from the guns are pointed in the best possible way towards the barrel and there is no loss in the space round the barrels. Furthermore this makes possible even and best-quality work. If the speed of turning of the barrels 3 about their axes is stepped up—something which is possible in certain cases—the number of turns of barrels 3 on moving past the spraycoating units is increased and a greater number of spraycoatings may be put on.

The spraycoating guns 20 are so placed that in each case two barrels 3, in the case of greater sizes of apparatus, even more barrels 3 or in the case of smaller workpieces a greater number of workpieces, may be spraycoated at the same time so that the output of the spraycoating apparatus is even further stepped up, if more specially spraycoating is to take place with more than one color. In this respect the spraycoating guns are, in each case, placed in two or more lines or rows which are placed, so as to be able to be turned, with a spacing round the shaft 5 by that angle made by the middle points of two barrels 3 next to each other on the transport apparatus and the middle point of the shaft 5. In the case of the form of the apparatus in the present case this angle is 360/7°. Between the spray guns it is furthermore possible for metal shields 21 to be placed making it possible for barrels to be spraycoated with different colors. In the case of guns placed in two rows this may furthermore take place one after the other.

In order to make it possible for the barrels to be spraycoated inside as well, that is to say in the case of barrels without a top or a floor, it is possible for spraycoating units 22 to be placed on the transport wheel 4 in guides so as to be able to be changed in position. Adjustment of these spraycoating units is possible along the axis running through the middle point of the shaft 5 and the middle point between two support pins as indicated schematically by arrow 22*a*. The spraycoating units may furthermore be designed for being changed in position horizontally as well so that they are able to go into the inside of the vessels with a regular rhythm. The motion inwards and outwards is controlled using any normal control unit, for example one with copying templates.

For the same purpose near the transport wheel 4 on the shaft 5 it is possible to have spraycoating units 23 able to undergo changes in slope and level as indicated by arrow 23*a* and which, as well, may be placed so as to be able to be moved horizontally into the barrels as indicated by arrow 23*b*. In this respect parts will be present as well for joining the sloping motion with the transport speed of the barrels along a common way before spraying units are turned back into the starting position. If barrel wall structures, that is to say without ends (tops and floors) are to be spraycoated, it is possible for even further like spraying units to be placed on the shaft 5 and which are responsible for inner spraycoating from the other end.

HOW THE APPARATUS IS WORKED

An account of the workings of the apparatus will now be presented. A barrel 3 freed by the timing lever is rolled between two support pins 7 and is taken up by their rolling cones 11, a smoother take-up being made possible because only the top turning pin 7, and for this reason, its rolling cones 11 are turned by the friction driving system 15 and 16. Because of the unbroken or continuous turning motion of the transport wheel the barrel 3 is transported to the outlet. Because of this unbroken turning motion the rate of output of the spraycoating apparatus is importantly stepped up. As this motion takes place the barrel 3, as soon as it has come clear of the inlet structure 1, is turned about its axis, because on further motion the lower support pin 7 as well comes up against the friction driving system 15 and 16. At the same time the barrel 3 is spraycoated. The spraycoating units are moved at the same speed or in step with the transport wheel 4. The change in angle they make before being turned back into the starting position is made as great as possible, in order, dependent on the turning speed of the barrels 3 about their own axes, for more than one coating may be put on, that is to say the higher the speed of the barrels 3 about their axes, the greater the number of coatings which may be put on. Near the outlet structure 18 the lower support pin 7 comes out of engagement with the friction driving system 15 and 16 so that, partly under its own weight, the spraycoated barrel will automatically go out of the spraycoating apparatus by way of the outlet structure 18.

As soon as barrels are to be spraycoated which are different in size, the driving unit 13*a* is turned on and by way of the chain 13 and the chain wheels 12 the bushes 9 and the shafts 10 of the support pins 7 are moved into or out of each other, dependent on the direction of turning. This takes place till the workpieces to be spraycoated may readily be taken up by the transport system and transported while being turned about their axes.

If, furthermore, barrels with very much different diameter sizes are to be spraycoated, so that they are not able to be supported by the cone faces of the rolling cones 11 even with the possible adjustment, use will be made of stepped rolling cones or all rolling cones will have their place taken completely by another group of cone. It is furthermore possible for all turning pins to be moved radially for adjustment.

The spraycoating apparatus of the invention has very high output speeds. Dependent on the spraying process and the spraycoating materials outputs of over one thousand 210 l. steel barrels are made possible with an even, high work quality and a low weight of use of the spraycoating material. Furthermore the spraycoating apparatus may readily undergo adjustment for different sizes of the workpieces for spraycoating.

I claim:

1. An apparatus for spraycoating of cylindrical bodies such as barrels, bins, drums, buckets and the like, comprising:

(a) an inlet structure having a lever for controlling the run-in of cylindrical bodies into a transport system;

(b) a transport system for transporting said cylindrical bodies from said inlet structure to an outlet structure, comprising an upright transport wheel mounted for rotation about an axis, means for continuously rotatingly driving said transport wheel, a plurality of adjustable-length horizontal support pins supported about said transport wheel at circumferentially spaced locations radially displaced from said axis, a pair of rolling cones mounted on and spaced apart along each said horizontal support pin; said cones rotatable relative to said transport wheel, means for adjusting the length of said horizontal support pins to vary the spacing between said rolling cones; and means for rotatingly driving said rolling cones;

(c) spraycoating units mounted for spraycoating the exterior surfaces of cylindrical bodies being transported by said transport system; and (d) an outlet structure, whereby said cylindrical bodies are transported continuously from said inlet structure to said outlet structure with rotation of said transport wheel, each cylindrical body supported by pairs of said rolling cones mounted on adjacent said horizontal support pins and rotated about its own axis with rotation of said rolling cones.

2. A spraycoating apparatus according to claim 1, wherein each said horizontal support pin comprises first and second support pin members on which are mounted first and second rolling cones, respectively, said first and second support pin members movable relative to one another in the direction of a longitudinal axis of the horizontal support pin.

3. A spraycoating apparatus according to claim 2, wherein said rolling cones are keyed on said horizontal support pins, and wherein said horizontal support pins are rotatable relative to said transport wheel.

4. A spraycoating apparatus according to claim 3, wherein said first support pin member comprises a bush and said second support pin member comprises a shaft located within and keyed to said bush such that said shaft is movable relative to said bush along the longitudinal axis of the horizontal support pin.

5. A spraycoating apparatus according to claim 4, further comprising a second pair of rolling cones mounted on each said horizontal support pin, said second pair of rolling cones differing in size from said first-mentioned pair of rolling cones.

6. A spraycoating apparatus according to claim 4, wherein said rolling cones comprise stepped rolling cones.

7. A spraycoating apparatus according to claim 3, further comprising guide tubes joined to said transport wheel, each said horizontal support pin rotatably supported in a respective guide tube.

8. A spraycoating apparatus according to claim 7, further comprising a V-belt wheel fixedly joined to each said horizontal support pin for rotation therewith, said cone driving means including a V-belt for driving said V-belt wheels.

9. A spraycoating apparatus according to claim 8, further comprising guide rollers engaging said V-belt such that, for a given rotational position of the transport wheel, all horizontal support pins above the rotational axis of the transport wheel and at least the lowermost horizontal support pins are drivingly coupled to the V-belt.

10. A spraycoating apparatus according to claim 7, wherein said guide tubes are radially adjustable relative to said transport wheel axis.

11. A spraycoating apparatus according to claim 1, wherein said length adjusting means comprises a driving system having respective rotatable chain wheels coupled for adjusting the length of said horizontal support pins when said chain wheels are rotated, a chain engaging said chain wheels, and means for driving said chain to simultaneously adjust the length of all said horizontal support pins.

12. A spraycoating apparatus according to claim 1, further comprising a shaft on which said transport wheel is mounted, a plurality of bearings rotatably supporting said shaft, and a spur gearwheel fixed for rotation with said transport wheel and coupled to said transport wheel driving means.

13. A spraycoating apparatus according to claim 1, wherein said spraycoating units comprise a number of spray guns, said spray guns being adjustable in angle and in slope by pivotal movement about the rotational axis of said transport wheel.

14. A spraycoating apparatus according to claim 13, further comprising metal shields placed between adjacent spray guns.

15. A spraycoating apparatus according to claim 14, wherein said spraycoating units are located between adjacent horizontal support pins, said spraycoating units turning with the transport wheel and able to be changed in position.

16. A spraycoating apparatus according to claim 13, wherein said transport wheel is mounted on a shaft, and wherein spraycoating units are mounted adjacent at least one end of said shaft, capable of being adjusted in slope about said axis and in level.

17. A spraycoating apparatus according to claim 16, wherein said spraycoating units mounted adjacent at least one end of said shaft are horizontally movable into positions inside the cylindrical bodies for spraycoating interior surfaces of the cylindrical bodies.

* * * * *